US006223720B1

(12) United States Patent
Kramer et al.

(10) Patent No.: US 6,223,720 B1
(45) Date of Patent: May 1, 2001

(54) DIESEL ENGINE SPEED CONTROL TO PREVENT UNDER-RUN

(75) Inventors: Thomas M. Kramer, Lombard; Jeffrey A. McElroy, Villa Park, both of IL (US)

(73) Assignee: International Truck and Engine Corp., Chicago, IL (US)

( * ) Notice: Subject to any disclaimer, the term of this patent is extended or adjusted under 35 U.S.C. 154(b) by 0 days.

(21) Appl. No.: 09/586,280

(22) Filed: Jun. 2, 2000

(51) Int. Cl.[7] ..... F02D 31/00
(52) U.S. Cl. ..... 123/357
(58) Field of Search ..... 123/446, 357

(56) References Cited

U.S. PATENT DOCUMENTS

| | | | | |
|---|---|---|---|---|
| 5,261,378 | * | 11/1993 | Fenchel et al. | 123/357 |
| 6,035,825 | * | 3/2000 | Worth et al. | 123/357 |
| 6,035,829 | * | 3/2000 | Hartke et al. | 123/357 |
| 6,092,504 | * | 7/2000 | Barnes et al. | 123/357 |
| 6,098,593 | * | 8/2000 | Aschner | 123/357 |

OTHER PUBLICATIONS

Governor Version 3.0 submitted by Applicant in paper #2. Dated Jul. 8, 1997.*

* cited by examiner

*Primary Examiner*—Thomas N. Moulis
(74) *Attorney, Agent, or Firm*—Dennis K. Sullivan; Jeffrey P. Calfa; Gilberto Hernandez

(57) ABSTRACT

An engine speed governor controls a diesel engine in a motor vehicle. The engine control has a processor for processing data for Engine speed governing, including developing fuel request data comprising data components derived from proportional, integral, and derivative processing of difference between actual engine speed and requested engine speed. A data source, such as a gear selector switch in an automatic transmission vehicle or a clutch switch in a manual transmission vehicle, distinguishes between engagement and disengagerrent of the vehicle driveline with and from the engine. A respective first table, such as a map, is associated with each of the proportional, integral, and derivative processing and provides selectable calibration values used by the processor to develop the fuel request data when the driveline is engaged with the engine. A respective second table, such as a function, associated with each of the proportional, integral, and derivative processing provides selectable calibration values used by the processor to develop the fuel request data when the driveline is disengaged from the engine. The invention serves to counter engine speed under-run, especially after prolonged vehicle coasting, by more aggressive proportional control. The principles of the invention may also be embodied in speed governing of a stationary diesel engine.

13 Claims, 2 Drawing Sheets

DIESEL ENGINE SPEED CONTROL TO PREVENT UNDER-RUN

FIELD OF THE INVENTION

This invention relates generally to controls for motor vehicle engines, and in particular it relates to an electronic engine control that regulates the speed of a diesel engine to prevent under-run.

BACKGROUND AND SUMMARY OF THE INVENTION

An electronic control for a diesel engine may have a speed governor that embodies closed-loop control of engine speed. The closed-loop control may include proportion, integral, and derivative (sometimes referred to as PID) functions. When an engine speed request is less than a low idle speed set-point defined by a set-point table, the control is effective to maintain speed substantially at that setpoint by clamping the integral function in accordance with a calibratable limit. The inclusion of such an integral clamping function has an effect on the PID control when the speed command is not below the low idle speed set-point, and for certain conditions, may prevent the integral term from contributing to engine speed governing in an optimal manner for such conditions. An example of one such condition is a change in the speed request that calls for engine acceleration where continued wind-up of the integral term is desirable. The presence of the clamping function may impair wind-up of the integral term in a way that affects the ability of the engine to accElerate in an optimal manner.

Moreover, when an engine is running at or near its low idle speed set-point, it may for any of various reasons experience under-running, meaning that the engine speed actually drops below the low idle speed set-point. Should the engine be unable to recover fast enough, the speed may drop sufficiently to cause the engine to stall. Stalling may be somewhat unpredictable, and possibly attributable to the effect of certain factors inherent in the mass production of engines and/or of components in a drivetrain which is coupled to the engine. For example, if a drivetrain is slightly less efficient than the norm, yet still within acceptable tolerance, and if the engine is delivering less torque than the norm, yet still within acceptable tolerance, a combination of the two, even though improbable in any given mass-produced vehicle, may occur in some vehicles and render the engine prone to stalling should the speed drop below the low idle speed set-point. Statistical probabilities applied to mass production of manufactured components suggest that the probability of any particular vehicle having such a combination is sufficiently low that raising the low idle speed setpoint for all engines, which would needlessly waste fuel when the engines are idling and might have implications on tailpipe emission levels, would be an inefficient solution. Yet, the occurrence of the condition in a vehicle could lead to dissatisfaction for the customer involved if repeated stalling were to occur.

One solution to the problem would be to readjust the engine calibration by supplying an excess of fuel, but that solution may be unacceptable because of adverse impact on tailpipe emissions. Accordingly, it is believed that a better solution would guard against such an event without penalizing idle fuel consumption of all vehicles and without adverse tailpipe emission implications would be useful. Moreover, a solution that would be especially cost-effective would be even more desirable.

It is toward such a solution that the present invention is directed.

One general aspect of the invention relates to an engine speed governor of a diesel engine in a motor vehicle having a driveline that can be selectively engaged with and disengaged from the engine. The speed governor comprises an engine control comprising a processor for processing data for engine speed governing, including developing fuel request data comprising data components derived from proportional, integral, and derivative processing of difference between actual engine speed and requested engine speed. A data source distinguishes between engagement and disengagement of the driveline with and from the engine. A first table is associated with at least one of the proportional, integral, and derivative processing and provides selectable calibration values used by the processor during that processing to develop the fuel request data when the data source for distinguishing between engagement and disengagement of the driveline with and from the engine indicates engagement of the driveline with the engine. A second table is associated with the at least one of the proportional, integral, and derivative processing and provides selectable calibration values used by the processor during that processing to develop the fuel request data when the data source for distinguishing between engagement and disengagement of the driveline with and from the engine indicates disengagement of the driveline from the engine.

Another general aspect of the invention relates to an engine speed governor for a diesel engine including a load that can be selectively engaged with and disengaged from the engine. The governor comprises a processor for processing data for engine speed governing, including developing fuel request data comprising data components derived from proportional and integral processing of difference between actual engine speed and requested engine speed. A data source distinguishes between engagement and disengagement of the load with and from the engine. A first table associated with at least one of the proportional and integral processing provides selectable calibration values used by the processor during that processing to develop the fuel request data when the data source for distinguishing between engagement and disengagement of the load with and from the engine indicates engagement of the load with the engine. A second table associated with the at least one of the proportional and integral processing provides selectable calibration values used by the processor during that processing to develop the fuel request data when the data source for distinguishing between engagement and disengagement of the driveline with and from the engine indicates disengagement of the load from the engine.

The foregoing, along with further features and advantages of the invention, will be seen in the following disclosure of a presently preferred embodiment of the invention depicting the best mode contemplated at this time for carrying out the invention. The disclosure includes drawings, as now briefly described.

DESCRIPTION OF THE PREFERRED EMBODIMENT

Figure 1:
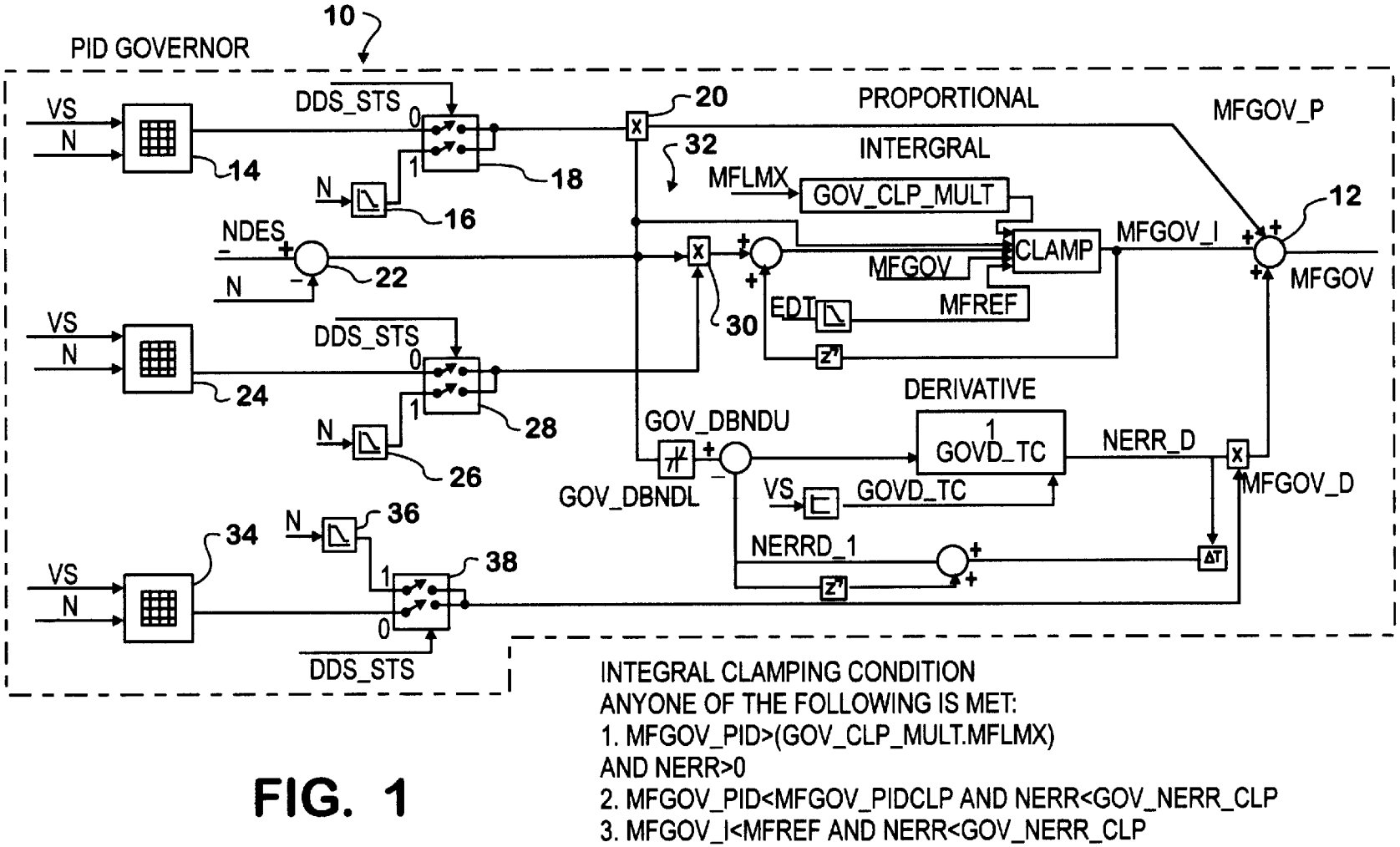
FIG. 1 is a schematic diagram of that portion of an exemplary electronic engine control relevant to principles of the present invention. The diagram depicts software functions contained in a processor based control for run mode of the engine.

FIG. 1 shows a software implementation of a PID governor 10 in an electronic engine control of a diesel engine that powers a motor vehicle such as a truck. The control is microprocessor-based and processes input data according to stored algorithms to create output data for engine control. PID governor 10 develops output data MFGOV which represents a value corresponding to desired fueling of the engine for control of fuel into the engine cylinders.

Output data MFGOV comprises three components, a proportional data component MFGOV_P, an integral data component MFGOV_I, and a derivative data component MFGOV_D. The three components are summed together by a summation step 12 to create output data MFGOV. While each of the three respective components is developed in its own particular way by PID governor 10, each is developed by processing certain common input data representing vehicle speed and engine speed respectively, namely a data input VS and a data input N respectively. Input data such as VS and N is published on a data bus of the vehicle and updated at an appropriate update rates so that the data accurately reflects the values of the respective parameters in real time.

For developing proportional cata component MFGOV_P, PID governor 10 employs a look-up table, or map, 14 containing values, Each of which is correlated with a respective set of values of data inputs VS and N. The data inputs VS and N cover respective ranges of vehicle speed and engine speed, and the size of table 14 depends on the extents of those ranges and the degree of resolution of each data input. Hence, table 14 may be considered a two-dimensional table because it is premised on values of two variables to define each set of data inputs.

Another table 16 that contains values correlated with engine speed alone is also associated with the development of proportional data component MFGOV_P. Table 16 may be considered a one dimensional table because it is premised on values of only one variable to define the data input. Such a one-dimensional table is also sometimes referred to as a function. At any given time however, only one of tables 14 and 16, to the exclusion of the other, is actually used for data processing. Which table is actually used at any given time is determined by the state of a software switch 18. The significance of software switch 18 and how it is controlled will be more fully explained later. Thus, a value from one of either table 14 or table 16 will be processed, depending on the state of software switch 18.

The processing comprises a step 20 that multiplies the appropriate value from the selected table by the value of calculated data NERR, which is calculated by a step 22 that subtracts engine speed data N from requested engine speed data NDES. Data NDES represents requested engine speed as determined by the processor from various data inputs, including an accelerator position sensor, in a fashion that does not directly bear on principles of the present invention. Suffice it to say that the calculation of requested engine speed may be performed by the execution of any algorithm appropriate to the particular engine and its associated control. The difference between requested engine speed and actual engine speed represents error that the processor will strive to null out by creating suitable values of output data MFGOV for engine fueling. The result of multiplication step 20 is a calculated value for the proportional data component MFGOV_P.

For developing integral data component MFGOV_I, PID governor 10 employs a look-up table, or map, 24 containing values, each of which is correlated with a respective set of values of data inputs VS and N. As was true for table 14, the 3size of table 24 depends on the extents of the ranges of the data inputs and their degrees of resolution. Another table, or function, 26 that contains values correlated with engine speed alone is also associated with the development of integral data component MFGOV_I. However, at any given time, only one of tables 24 and 26, to the exclusion of the other, is actually used for data processing, and as was true for tables 14 and 16, which one of tables 24 and 26 is actually used to execute the algorithm is determined by the state of another software switch 28 that is controlled in common with switch 18. Thus, a value from either table 24 or from table 26 will be processed, depending on the state of software switch 28, with the processing comprising a step 30 that multiplies that value by the value of the calculated data NERR. The result of multiplication step 30 is a value that is used in processing performed by executing an integration algorithm 32 to develop a value of the integral data component MFGOV_I. The algorithm includes anti-wind-up clamping logic.

Integrating of the product of GOV_KI and NERR is subject to certain rules of algorithm 32. Integration will be performed except when certain conditions defined by the rules call for it to cease, thereby causing the value of data MF_GOV_I to be clamped at the value it has when the integrating ceases. The rules involve certain relationships involving certain data, and those for the present example are included in FIG. 1. Clamping is the act of simply stopping integration such that the value of MFGOV_I remains unchanged until integration is allowed to resume.

For developing derivative data component MFGOV_D, PID governor 10 employs a look-up table, or map, 34 containing values, each of which is correlated with a respective set of values of data inputs VS and N. As was true for tables 14 and 24, the size of table 34 depends on the extents of the ranges of the data inputs and their degrees of resolution. Another table 36 that contains values correlated with engine speed alone is also associated with the development of derivative data component MFGOV_D. However, at any given time, only one of tables 34 and 36, to the exclusion of the other, is actually used for data processing, and as was true for tables 14 and 16, which one of tables 24 and 26 is actually used to execute the algorithm is determined by the state of another software switch 28 that is controlled in common with switch 18. Which table is actually used at any given time is determined by the state of a software switch 38 that is controlled in common with switches 18 and 28. Thus, a value either from table 34 or from table 36 will be processed, depending on the state of software switch 38, with the processing comprising a step 40 that multiplies that value by the value of calculated data NERR_D. The result of multiplication step 40 is a value of the derivative data component MFGOV_D.

NERR_D is derived from NERR by the engine controller software calculating the rate of change of engine speed N, divided by the rate of change in execution time of the inherent strategy, 100 Hz, to allow the engine speed control governor to anticipate speed error changes. Similar to table 34, table 36 provides further fine tuning of the governor; however this portion of the control algorithm is normally tuned to a null value in this particular example.

The disclosed implementation of the invention utilizes a data input DDS_STS to set the states of switches 18, 28, 38. When DDS_STS is low (binary logic "0" state), data from tables 14, 24, and 34 is used in the respective multiplication steps 20, 30, and 40. When DDS_STS is high (binary logic "1" state), data from tables 16, 26, and 36 is used in the respective multiplication steps 20, 30, and 40.

Data input DDS_STS represents the status of the vehicle driveline with respect to the engine. That status can be either "engaged" or "disengaged". Engaged status means that the driveline is engaged with the engine; disengaged status means that it is not. In a vehicle that has an automatic transmission, the driveline is coupled through the transmission to driven wheels. When the transmission is placed in a drive gear by a gear selector mechanism, the driveline is engaged with the engine, allowing the engine to propel the vehicle when the vehicle accelerator is depressed by the driver. When the transmission is placed in neutral by the gear selector mechanism, the driveline is disengaged from the engine. In a vehicle that has a manual transmission, the driveline is coupled through a clutch and manual transmission to driven wheels. When the transmission is placed in a drive gear by a gear selector mechanism and the clutch is engaged, the driveline is coupled through the transmission and clutch for engagement with the engine, allowing the engine to propel tie vehicle according to the extent to which the accelerator is being depressed. When the driver disengages the clutch, the transmission and driveline cease being coupled to the engine.

In the case of a vehicle that has an automatic transmission, the data input DDS_STS may be obtained from a switch, or sensor, that senses gear selection to distinguish between neutral and drive gears. In the case of a vehicle that has a manual transmission and clutch, the data input DDS_STS may be obtained from a switch, or sensor, that senses clutch operation by the driver to distinguish between engagement and disengagement of the clutch.

Hence in a vehicle that has an automatic transmission, a low state of data input DDS_STS signifies that the transmission is in a drive gear rather than in neutral while a high state would signify the opposite. In a vehicle that has a manual transmission and clutch, a low state of data input DDS_STS signifies that the clutch is engaged while a high state would signify clutch disengagement.

The invention is intended to avoid potential engine stalling that could occur during certain operating conditions in both manual and automatic transmission vehicles, particularly during conditions where the engine is over-running requested speed. An example of such a condition would occur when the vehicle has been traveling along a road and the driver decides, for whatever reason, to allow it to coast, typically releasing the accelerator pedal, while the clutch remains engaged in a manual transmission vehicle and the gear selector remains in drive gear in an automatic transmission vehicle. Tables 14, 24, and 34 continue to be used during such coasting. During the coast, the integrator portion of governor 10 tends to wind up, meaning that it continues to subtract fuel from the fueling request represented by data MFGOV because of the continuing disparity between the engine speed request and actual engine speed, even though the magnitude of the disparity may be diminishing. While integration algorithm 32 may include some anti-wind-up, it is typically limited because of the need for the integrator to provide enough positive fueling when the disparity has an opposite sign, meaning when the actual speed is below the requested speed and the integrator should be adding fuel to the fueling request.

Upon the driveline being disengaged from the engine after extended vehicle coasting while in gear, which at times may happen as vehicle speed is approaching zero and engine speed is approaching low idle speed, continued use of data from tables 14, 24, and 34 may prevent governor 10 from responding sufficiently quickly to avoid engine under-run and possibly even stalling in certain vehicles. Even when an actual stall is avoided, occurrence of engine under-run may give the driver an undesirable sensation or feeling about the vehicle, possibly leading to a warranty claim.

With the inclusion of switches 18, 28, and 38, data input DDS_STS, and tables 16, 26, and 36, the latter three tables are substituted for tables 14, 24, and 34 when data input DDS_STS changes state from "low" to "high". Because that state change occurs quickly and only momentarily, the data values from the tables are selected to cause aggressive proportional control for countering incipient engine under-run. When the clutch of a manual transmission vehicle is once again engaged, or the gear selector of an automatic transmission vehicle placed in a drive gear, tables 14, 24, and 34 become immediately effective once again so that the vehicle will be accelerated in intended optimal fashion.

Figure 2:
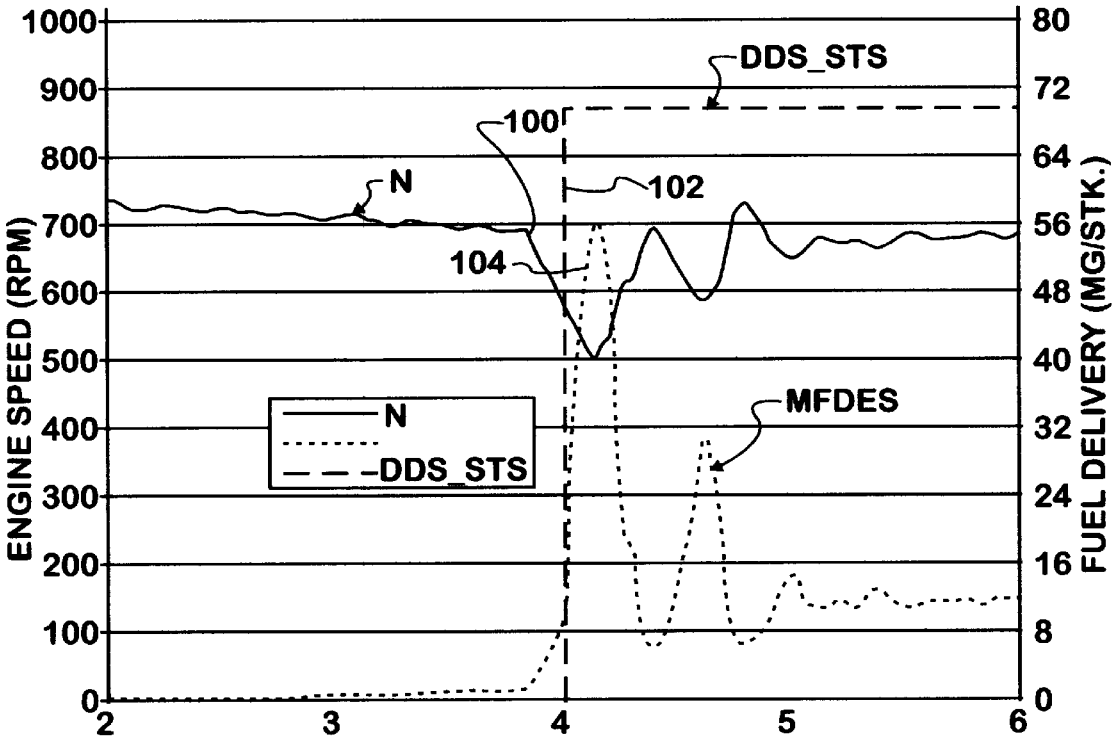
FIG. 2 shows several graph plots, superimposed on a graph, to demonstrate representative effects of the invention.

FIG. 2 graphically portrays the effectiveness of the invention. A trace N represents engine speed. A trace DDS_STS represents the status of the driveline. At a point 100 engine speed begins to rapidly decrease below about 700 RPM. The driver of the vehicle disengages the driveline from the engine by either depressing the clutch or shifting the gear selector to neutral. The status of DDS_STS changes from "low" to "high", as marked at 102. Tables 16, 26, 36 are forthwith substituted for tables 14, 24, 34, causing a sharp increase 104 in the fueling request MFDES, which has equivalence with MFGOV in this mode of operation. The increased fueling of the engine counters the under-run. Both the fuel request and actual engine speed experience transient effects, but speed is eventually restored, settling at low idle speed, while the fuel request settles at a value for maintaining low idle speed.

The invention is believed advantageous not only for reasons mentioned earlier, but also because it can be implemented by software modification of existing engine controls. The signal DDS_STS can be derived from switches that are typically present in mass-produced vehicle, but if not, they could be easily designed into a vehicle. The invention may be applied to new vehicles and to vehicles already in service.

The invention may also be applied to diesel engines in other applications such as a stationary engine. When a stationary engine has been running under load and that load is suddenly disconnected, analogous to a clutch disengagement event that allows a manual transmission vehicle to begin coasting, a suitable input, for example a switch, analogous to the clutch switch in the vehicle, is effective to change the state of the software switches 18, 28, 38. Suitable modification may be made to account for the fact that vehicle speed would be absent in such a stationary application. To the extent that a PID governor did not actively use a derivative component in governing, principles of the invention may be embodied in PI control.

While a presently preferred Embodiment of the invention has been illustrated and described, it should be appreciated that principles of the invention are applicable to all embodiments that fall within the scope of the following claims.

What is claimed is:

1. An engine speed governor of a diesel engine in a motor vehicle having a driveline that can be selectively engaged with and disengaged from the engine, comprising:

an engine control comprising a processor for processing data for engine speed governing, including developing fuel request data comprising data components derived from proportional, integral, and derivative processing of difference between actual engine speed and requested engine speed;

a data source for distinguishing between engagement and disengagement of the driveline with and from the engine;

a first table associated with at east one of the proportional, integral, and derivative processing and providing selectable calibration values used by the processor during that processing to develop the fuel request data when the data source for distinguishing between engagement and disengagement of the driveline with and from the engine indicates engagement of the driveline with the engine; and a second table associated with the at least one of the proportional, integral, and derivative processing and providing selectable calibration values used by the processor during that processing to develop the fuel request data when the data source for distinguishing between engagement and disengagement of the driveline with and from the engine indicates disengagement of the driveline from the engine.

2. An engine speed governor of a diesel engine in a motor vehicle as set forth in claim 1 in which the driveline comprises an automatic transmission, and the data source for distinguishing between engagement and disengagement of the driveline with and from the engine comprises a signaling device associated with a gear selector mechanism of the automatic transmission to distinguish between the transmission being in a drive gear and in neutral.

3. An engine speed governor of a diesel engine in a motor vehicle as set forth in claim 1 in which the driveline comprises a manual transmission and a clutch, and the data source for distinguishing between engagement and disengagement of the driveline with and from the engine comprises a signaling device associated with the clutch to distinguish between the clutch being engaged and disengaged.

4. An engine speed governor of a diesel engine in a motor vehicle as set forth in claim 1 in which values of the respective first table correspond to respective sets of values of engine speed and vehicle speed, and values of the respective second table correspond to respective values of engine speed.

5. An engine speed governor of a diesel engine in a motor vehicle as set forth in claim 1 in which a respective first table is associated with a respective one of each of the proportional, integral, and derivative processing, and a respective second table is associated with a respective one of each of the proportional, integral, and derivative processing.

6. An engine speed governor of a diesel engine in a motor vehicle as set forth in claim 5 in which values of each of the first tables correspond to respective sets of values of engine speed and vehicle speed, and values of each of the second tables correspond to respective values of engine speed.

7. An engine speed governor for a diesel engine including a load that can be selectively engaged with and disengaged from the engine, comprising:

a processor for processing data for engine speed governing, including developing fuel request data comprising data components derived from proportional and integral processing of difference between actual engine speed and requested engine speed;

a data source for distinguishing between engagement and disengagement of the load with and from the engine;

a first table associated with at least one of the proportional and integral processing and providing selectable calibration values used by the processor during that processing to develop the fuel request data when the data source for distinguishing between engagement and disengagement of the load with and from the engine indicates engagement of the load with the engine; and a second table associated with the at least one of the proportional and integral processing and providing selectable calibration value used by the processor during that processing to develop the fuel request data when the data source for distinguishing between engagement and disengagement of the driveline with and from the engine indicates disengagement of the load from the engine.

8. An engine speed governor as set forth in claim 7 in which the first table comprises a two-dimensional table and the second table comprises a one-dimensional table.

9. An engine speed governor as set forth in claim 8 in which engine speed is a data input to both the first table and the second table.

10. An engine speed governor as set forth in claim 7 in which engine speed is a data input to both the first table and the second table.

11. An engine speed governor as set forth in claim 7 in which the data components further include a data component derived from derivative processing of difference between actual engine speed and requested engine speed.

12. An engine speed governor as set forth in claim 11 in which a respective first table is associated with a respective one of each of the proportional, integral, and derivative processing, and a respective second table is associated with a respective one of each of the proportional, integral, and derivative processing.

13. An engine speed governor as set forth in claim 12 in which values of each of the first tables correspond to respective sets of values of two variables, one of which is engine speed, and values of each of the second tables correspond to respective values of engine speed.

* * * * *